US005888093A

United States Patent [19]

Polgar et al.

[11] Patent Number: 5,888,093

[45] Date of Patent: Mar. 30, 1999

[54] FLOATING PANEL MOUNTING SYSTEM FOR ELECTRICAL CONNECTORS

[75] Inventors: Gary E. Polgar, Bolingbrook; Joseph D. Comerci, Elmhurst; Rupert J. Fry, Mount Prospect, all of Ill.

[73] Assignee: Molex Incorporated, Lisle, Ill.

[21] Appl. No.: 912,423

[22] Filed: Aug. 18, 1997

Related U.S. Application Data

[63] Continuation-in-part of Ser. No. 642,007, May 2, 1996.

[51] Int. Cl.[6] ..... H01R 13/73

[52] U.S. Cl. ..... 439/546; 439/248

[58] Field of Search ..... 439/546, 247, 439/248, 342, 347, 545

[56] References Cited

U.S. PATENT DOCUMENTS

| | | | |
|---|---|---|---|
| 3,912,335 | 10/1975 | Curado et al. | 339/128 |
| 3,912,355 | 10/1975 | Curado et al. | 339/128 |
| 4,029,953 | 6/1977 | Natoli | 240/8.16 |
| 4,761,144 | 8/1988 | Hunt, III et al. | 439/545 |
| 4,812,133 | 3/1989 | Fleak et al. | 439/248 |
| 5,017,151 | 5/1991 | Peterson | 439/248 |
| 5,127,852 | 7/1992 | Cravens et al. | 439/545 |
| 5,338,226 | 8/1994 | Bryce et al. | 439/571 |
| 5,407,363 | 4/1995 | Polgar et al. | 439/546 |

*Primary Examiner*—Steven L. Stephan
*Assistant Examiner*—Hal Moon Hyeon
*Attorney, Agent, or Firm*—Stephen Z. Weiss

[57] ABSTRACT

An electrical connector panel mounting system includes a panel having a given thickness between two surfaces and including a first opening formed with at least one radially extending locating portion and a second opening spaced from the first opening. A connector includes a dielectric housing inserted from one surface of the panel along an axis to an insertion position into the first opening in the panel. The housing has at least one radially extending locating flange for passing through the locating portion of the first opening as the housing is inserted thereinto. At least one radially extending stop flange is spaced axially and angularly from the locating flange for abutting the one surface of the panel when the locating flange clears the opposite surface of the panel. The housing is rotatable about the axis from its insertion position to a mounted position whereat the locating flange can abut the opposite surface of the panel to prevent axial removal of the housing back out of the first opening. The cross-sectional configuration of the housing is smaller than the first opening when in the mounted position to provide radial floating of the connector relative to the panel. A locking arm projects radially of the housing and includes a locking protrusion for engagement in the second opening when the housing is in its mounted position and for preventing rotation of the connector from the mounted position back to the insertion position. The second opening is larger than the locking protrusion to allow for the radial floating of the connector relative to the panel.

5 Claims, 6 Drawing Sheets

FLOATING PANEL MOUNTING SYSTEM FOR ELECTRICAL CONNECTORS

This is a continuation-in-part of co-pending application Ser. No. 08/642,007 filed on May 2, 1996.

FIELD OF THE INVENTION

This invention generally relates to the art of electrical connectors and, particularly, to an electrical connector floating panel mounting system.

BACKGROUND OF THE INVENTION

Panel mounted electrical connectors usually include a non-conductive or dielectric housing having a plurality of electrically conductive terminals mounted therein. the housing also includes means for mounting the connector to a panel. The panel mounted connector is mateable with other electrical apparatus, such as another connector, which, in turn, may be mounted to a second panel, a circuit board, a cable or discrete wires.

Quite often, the mating of a panel mounted electrical connector to another connector or circuit component is carried out under "blind mating" conditions such that precise alignment of the panel mounted connector with the other connector or circuit component cannot be assured. Blind mating of panel mounted connectors may occur in a wide variety of applications including components of copying machines, computer equipment, telecommunications equipment and like applications. Attempts to forcibly blind mate improperly aligned electrical connectors can damage the housings of the connectors, the fragile terminals of the housings or the panels to which the connectors are mounted. Improper alignment also may prevent complete mating, thereby negatively affecting the quality of the electrical connection.

Various prior art panel mounted electrical connectors have been provided with means for permitting a controlled amount of float between the connector housing and the associated panel to solve the above problems in blind mating of panel mounted connectors. Many such connectors have been fairly complex multi-component structures which may even be manufactured separately from the electrical connector and require complex assembly and installations.

The present invention is directed to providing such a panel mounted electrical connector which not only is provided with a floating action but which is locked in its floating, mounted position, all by extremely simple means.

SUMMARY OF THE INVENTION

An object, therefore, of the invention is to provide a new and improved floating panel mounting system for electrical connectors of the character described.

In the exemplary embodiment of the invention, the system includes a panel having a given thickness between two surfaces and including a first opening formed with at least one radially extending locating portion and a second opening spaced from the first opening. A connector includes a dielectric housing insertable from one surface of the panel along an axis to an insertion position into the first opening in the panel. The housing has at least one radially extending locating flange for passing through the locating portion of the first opening as the housing is inserted thereinto. The housing has at least one radially extending stop flange spaced axially and angularly from the locating flange for abutting the one surface of the panel when the locating flange clears the opposite surface of the panel. In the exemplary embodiment the housing is rotatable about the axis from its insertion position to a mounted position whereat the locating flange can abut the opposite surface of the panel to prevent axial removal of the housing back out of the first opening. In an alternate embodiment the first opening in the panel is modified so that the housing is slid from its insertion position to a mounted position whereat the locating flange can similarly prevent axial removal of the housing from the first opening. The cross-sectional configuration of the housing is smaller than the first opening when in the mounted position to provide radial floating of the connector relative to the panel.

The invention contemplates that the housing have a locking arm projecting radially therefrom. The locking arm includes a locking protrusion for engagement in the second opening in the panel when the housing is in its mounted position. The engagement of the locking protrusion in the second opening prevents rotation of the connector from the mounted position back to the insertion position. or in the alternate embodiment, prevents sliding of the connector from the mounted position back to the insertion position. The second opening is larger than the locking protrusion to allow for the aforesaid radial floating of the connector relative to the panel.

As disclosed herein, the second opening in the panel is circular, whereby the radial floating action of the connector is omni-directional. The locking protrusion preferably is generally cylindrical. The housing is molded of plastic material, and the locking arm is molded integrally therewith. The locking arm thereby is flexible such that the locking protrusion comprises a detent adapted for snapping into the second opening in the panel automatically when the housing is rotated or slide to its mounted position to lock the housing thereat.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
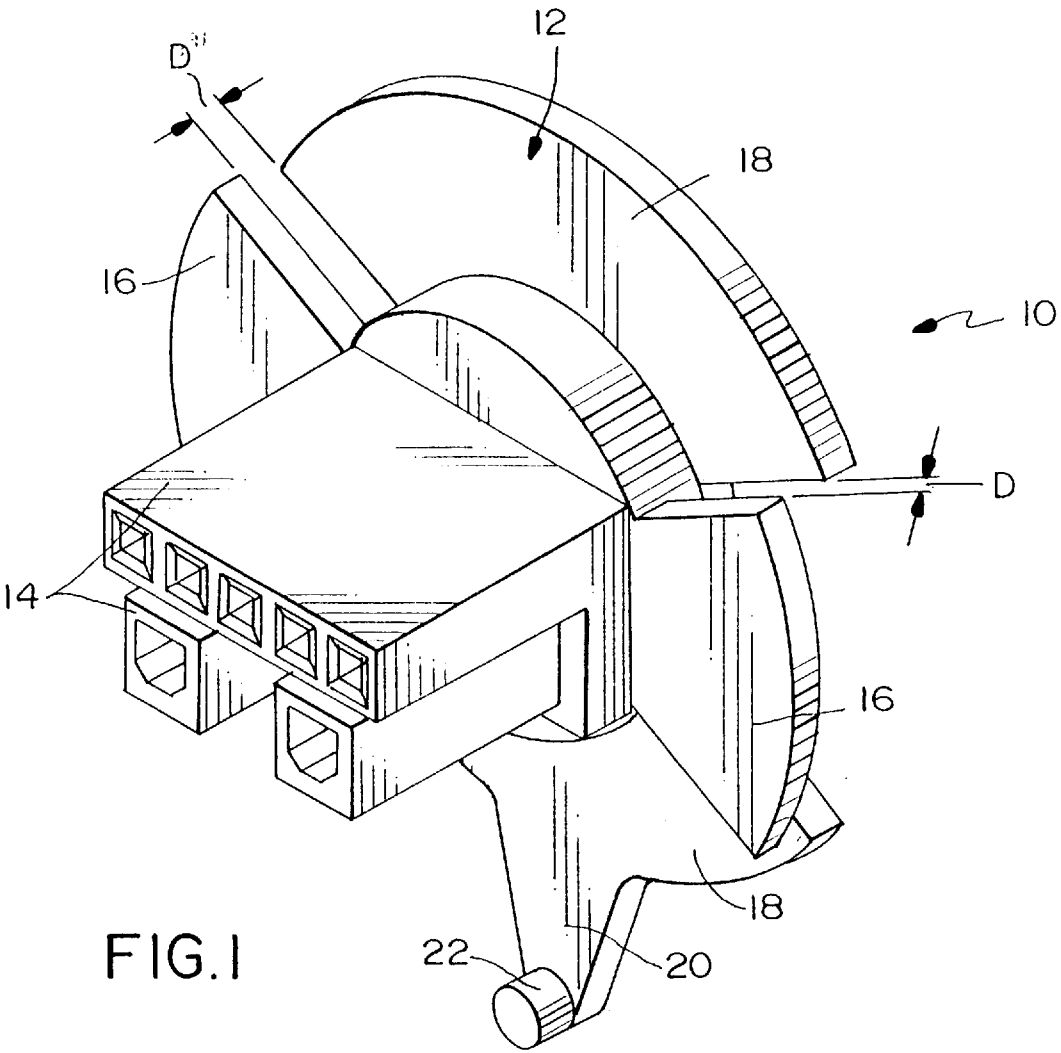
FIG. 1 is a perspective view of the electrical connector of the panel mounting system of the invention.
Figure 2:
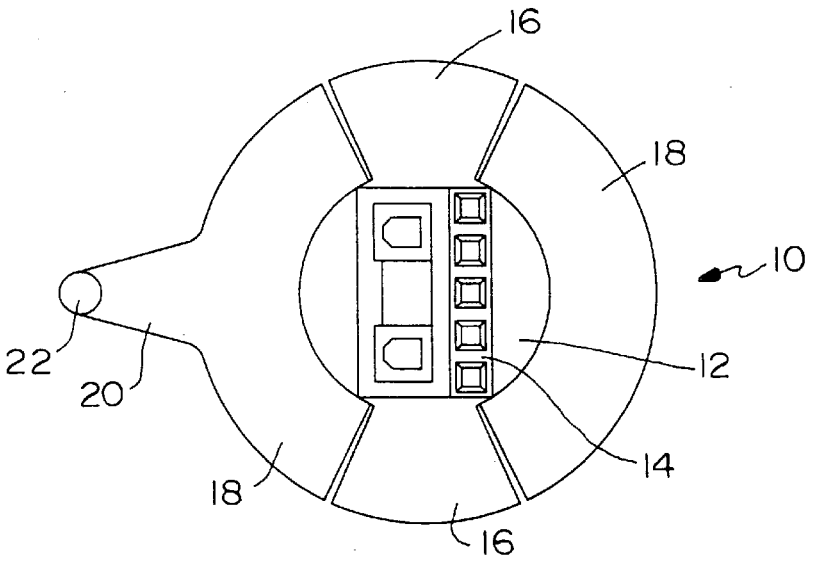
FIG. 2 is a front elevational view of the connector.

Referring to the drawings in greater detail, and first to FIGS. 1 and 2, the panel mounting system of the invention includes an electrical connector, generally designated 10, which has a dielectric housing 12 with a forwardly projecting mating portion 14. The mating portion is insertable through a panel (described hereinafter) for mating with the mating portion of a complementary connector on the opposite side of the panel.

Housing 12 of connector 10 includes a pair of diametrically disposed, radially outwardly extending locating flanges 16. The locating flanges are spaced axially and angularly from a pair of diametrically disposed, radially outwardly extending stop flanges 18. The stop flanges are spaced axially from the locating flanges by a distance "D" shown in FIG. 1 and define a panel receiving region therebetween. The stop flanges are larger, in an angular or circumferential direction, than the locating flanges. Lastly, a locking arm 20 projects radially outwardly of the housing and includes a forwardly projecting integral locking protrusion 22. Actually, the locking arm projects outwardly from one of the stop flanges 18 which, in turn, projects outwardly of the housing. Housing 12, including mating portion 14, locating flanges 16, stop flanges 18, locking arm 20 and locking protrusion 22 all are unitarily molded of dielectric material, such as plastic or the like.

Housing 12, particularly mating portion 14 of the housing, has a plurality of terminals (not shown) mounted therein which interengage with appropriate terminals of the complementary mating connector. Of course, it should be understood that mating portion 14 can take a wide variety of configurations and, consequently, the mating portion and the terminals are not described in detail herein. Preferably, the housing is circular or cylindrical in cross-sectional configuration.

Figure 3:
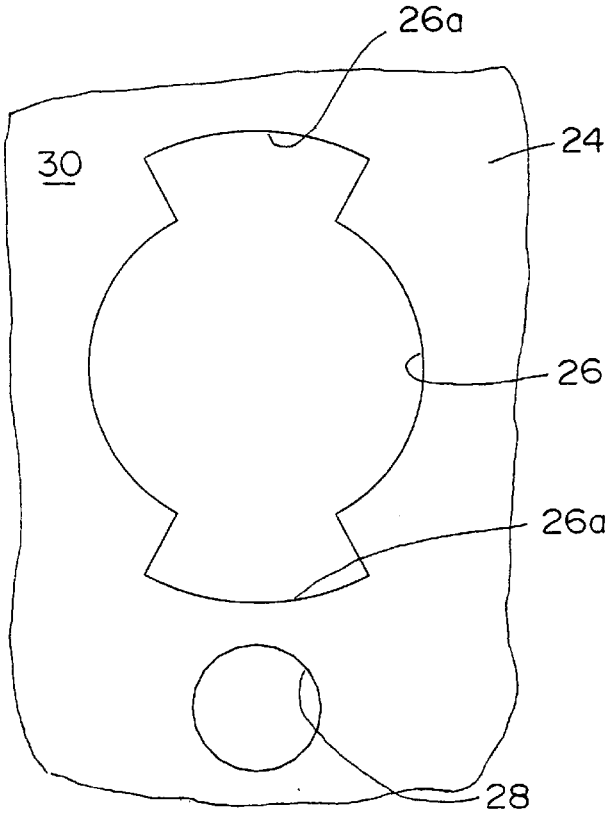
FIG. 3 is an elevational view of one side of the panel.

Referring to FIG. 3, the mounting system of the invention includes a cooperating panel 24 having a given thickness between two surfaces and including a larger, first circular opening 26 and a smaller, second circular opening 28. A pair of diametrically disposed locating portions or slots 26*a* extend radially outwardly of first opening 26.

Figure 4:
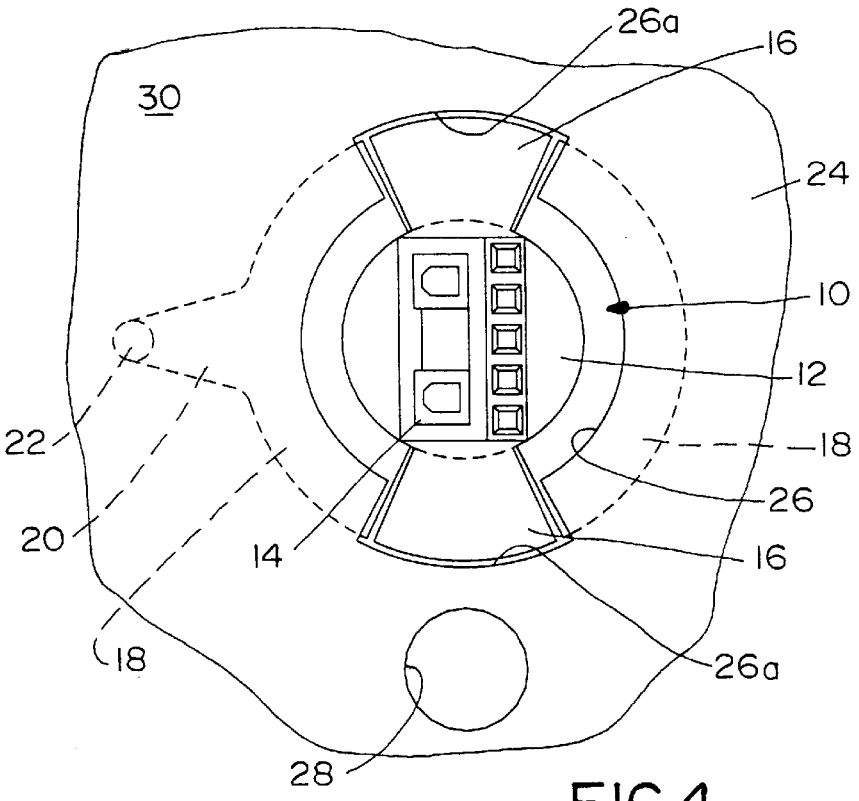
FIG. 4 is a view of the panel as seen in FIG. 3, with the connector positioned in the panel at the insertion position of the connector.

FIG. 4 shows electrical connector 10 in an insertion position relative to panel 24. As stated above, panel 24 has a given thickness between two surfaces. One surface can be considered the insertion surface or side of the panel and is the back side of the panel as viewed in the drawings. When looking at the drawings, the opposite surface or side of the panel is shown at 30 and, of course, is the surface of the panel opposite the insertion surface or side.

With that understanding, the connector is mounted to the panel by first inserting housing 12 through first opening 26 as shown in FIG. 4. The housing is inserted along an axis to the insertion position shown. In that position, radially extending locating flanges 16 move through locating portions 26*a* of the first opening until stop flanges 18 abut the insertion surface of the panel. It can be seen that in the insertion position of the connector as shown in FIG. 4, locking arm 20 and locking protrusion 22 are spaced angular approximately 90° from second opening 28 in the panel.

When housing 12 is inserted into opening 26 in the panel to an extent whereat stop flanges 18 abut the insertion surface or side of the panel, locating flanges 26 clear the opposite surface 30 of the panel because of the axial spacing "D" (FIG. 1) between the locating flanges and the stop flanges, and locking protrusion 22 abuts the insertion surface causing the locking arm 20 to bend. The connector then can be rotated in the direction of arrow "A" (FIG. 5) to a mounted position of housing 12 and whereat locking projection 22 registers with and snaps into second opening 28 in the panel. It can be seen that the second opening is substantially larger than the cross-sectional dimensions of locking protrusion 22. In the mounted position of connector 10 and housing 12 as viewed in FIG. 5, locating flanges 16 now abut opposite surface 30 of panel 24 to prevent axial removal of the housing and the connector back out of opening 26 in the panel.

With the entire housing structure being unitarily molded of plastic material, locking arm 20 is generally flexible. Consequently, locking protrusion 22 comprises a detent which is adapted for snapping into second opening 28 in the panel automatically when the housing is rotated from its insertion position shown in FIG. 4, in the direction of arrow "A" to its mounted or lock position shown in FIG. 5.

Figure 5:
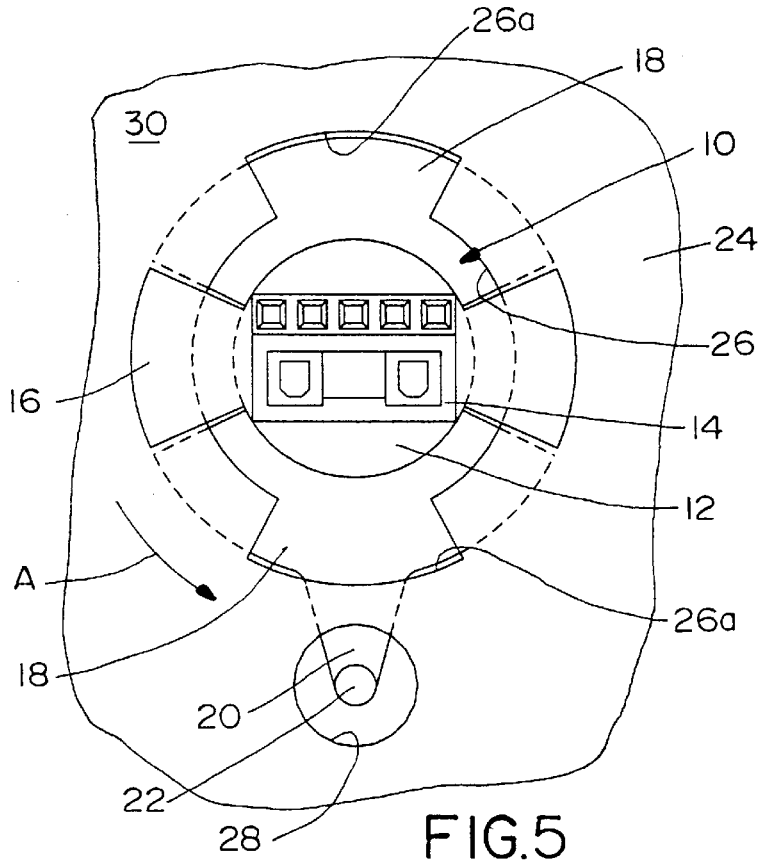
FIG. 5 is a view similar to that of FIG. 4, but with the connector rotated to its mounted position in the panel.

FIG. 4 best shows the degree that circular opening 26 in panel 24 is larger than cylindrical housing 12 of connector 10. FIG. 5 best shows the degree that circular second opening 28 is larger than locking protrusion 22. Therefore, it readily can be understood that the combination of these two enlarged openings allow for rotational and lateral floating of the connector relative to the panel. In other words, housing 12 can move considerably in a rotational and lateral direction within enlarged first opening 26, and locking protrusion 22 can move considerably in a rotational and lateral direction within enlarged second opening 28.

Figure 6:
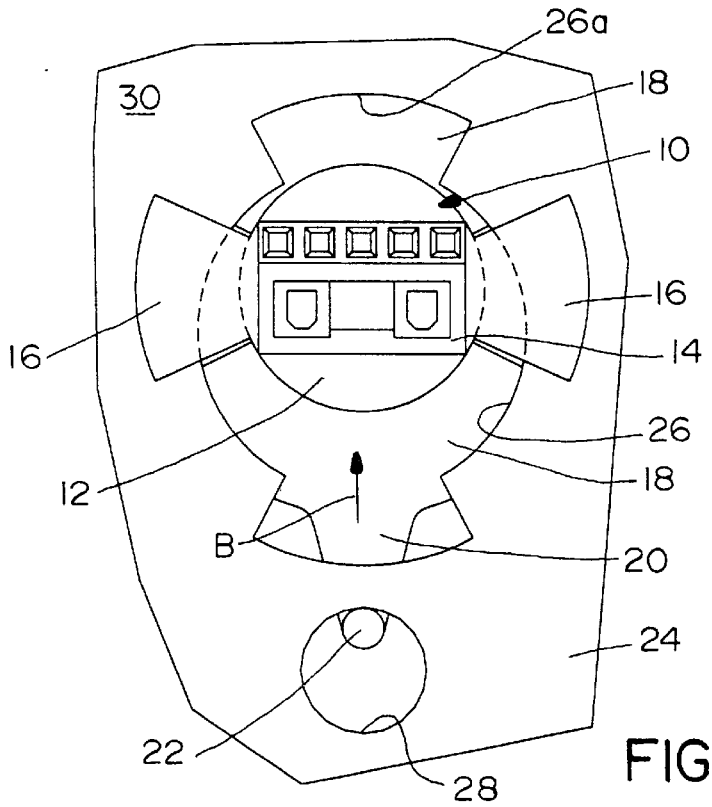
FIGS. 6–8 are various views similar to FIG. 5, showing various degrees of rotational and lateral floating movement of the connector relative to the panel in the mounted position of the connector.
Figure 7:
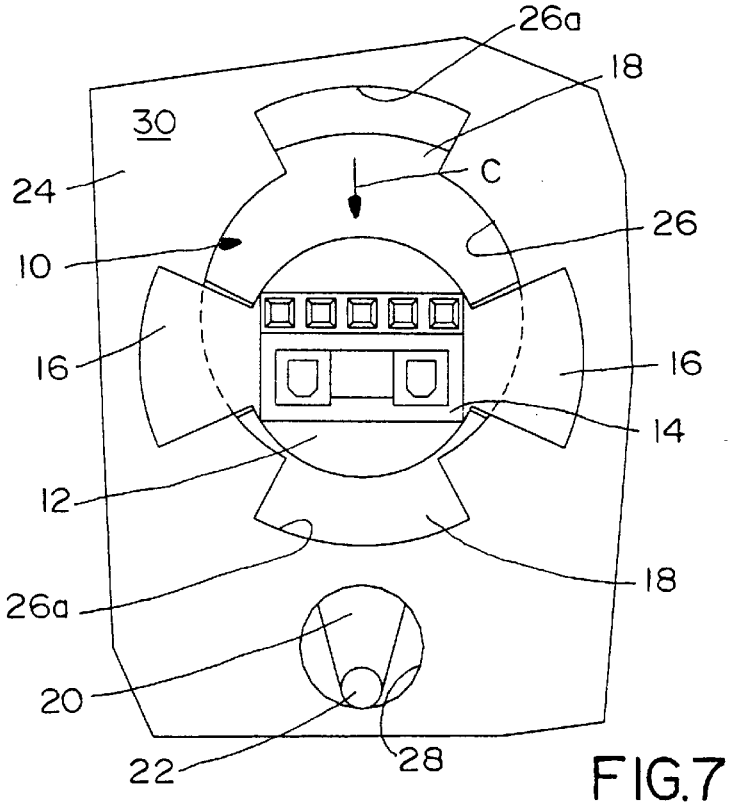
Figure 8:
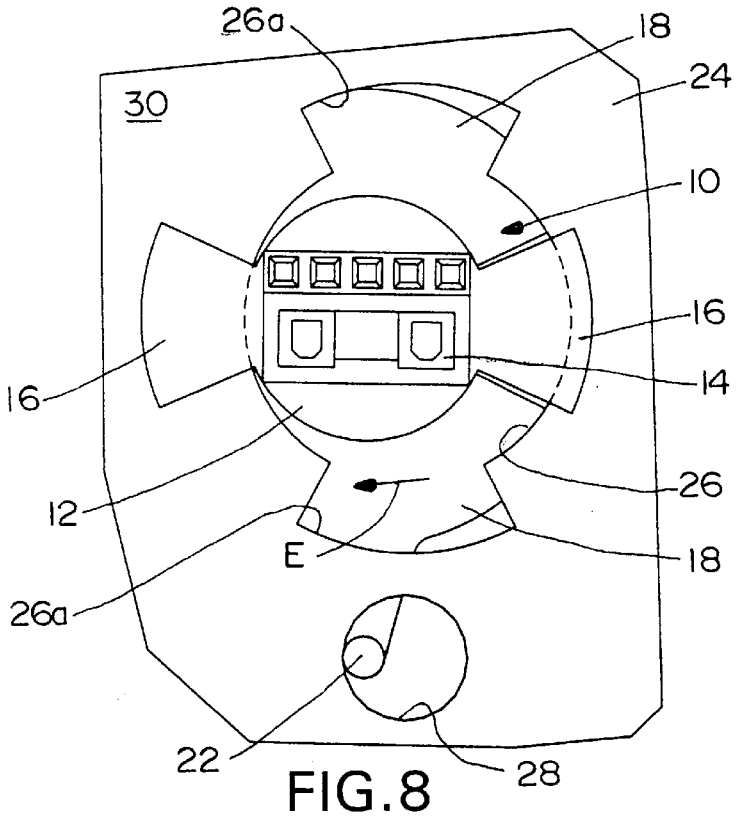

FIGS. 6–8 show various positions of connector 10 relative to panel 24 while the connector remains in its mounted position. In particular, FIG. 6 shows that connector 10 has moved upwardly (as viewed in the drawing) in the direction of arrow "B" until housing 12 has reached its upper limit position within first opening 26. Locking protrusion 22 also can be seen to have moved upwardly to its limit position within second opening 28.

FIG. 7 shows that connector 10 has moved considerably downwardly in the direction of arrow "C" relative to panel 24 until housing 12 has reached its downward limit position as viewed in the drawing within first aperture 26. Locking protrusion 22 also has been moved downwardly to its limit position within second opening 28.

FIG. 8 shows that connector 10 has moved considerably toward the left as viewed in the drawing, in the direction of arrow "E" relative to panel 24. It can be seen that housing 12 has moved to its left-most limit position within first opening 26, and, likewise, locking protrusion 22 has moved to its left-most limit position within second opening 28. Of course, the connector, the housing and the locking protrusion can move the same distance toward the right as viewed in the drawing, relative to panel 24, opposite the direction of arrow "E".

Figure 9:
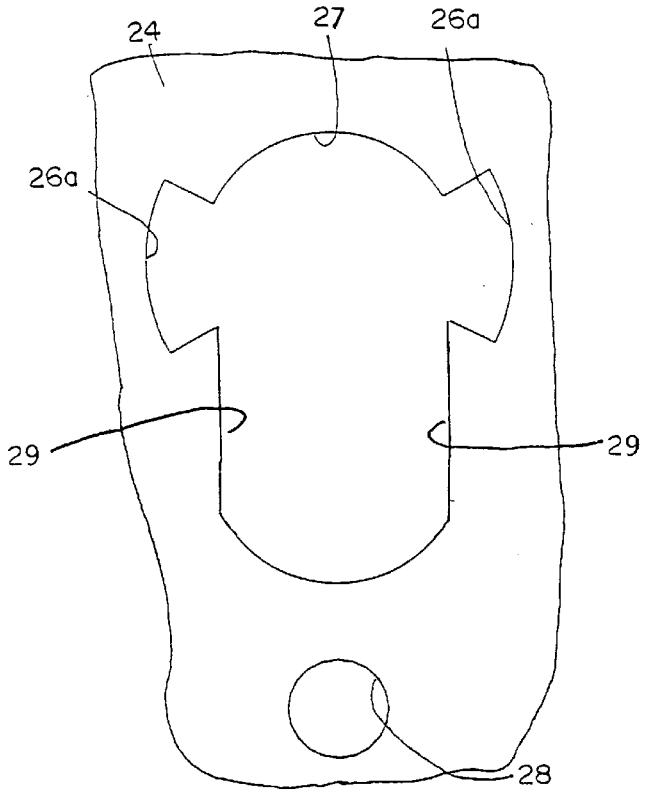
FIG. 9 is an elevation view of one side of the panel showing the alternate embodiment of the invention.

FIGS. 6–8, as described above, clearly illustrate the wide range of lateral floating action that is afforded between connector 10 and panel 24 while the connector still remains locked in its mounted position. With first opening 26 and second opening 28 being circular, and with housing 12 and locking protrusion 22 being cylindrical, an infinite number of omni-directional floating positions including partial rotation of the housing are afforded between the housing and the panel within the limit positions defined above in relation to FIGS. 6–8. Referring to FIG. 9, an alternate mounting system includes a cooperating panel 24, a first opening 27, and a smaller second opening 28. A pair of diametrically disposed locating portions or slots 26*a* extend radially outwardly of the first opening 27. An elongated portion defined by two elongated edges 29 is provided for the purpose described below.

Figure 10:
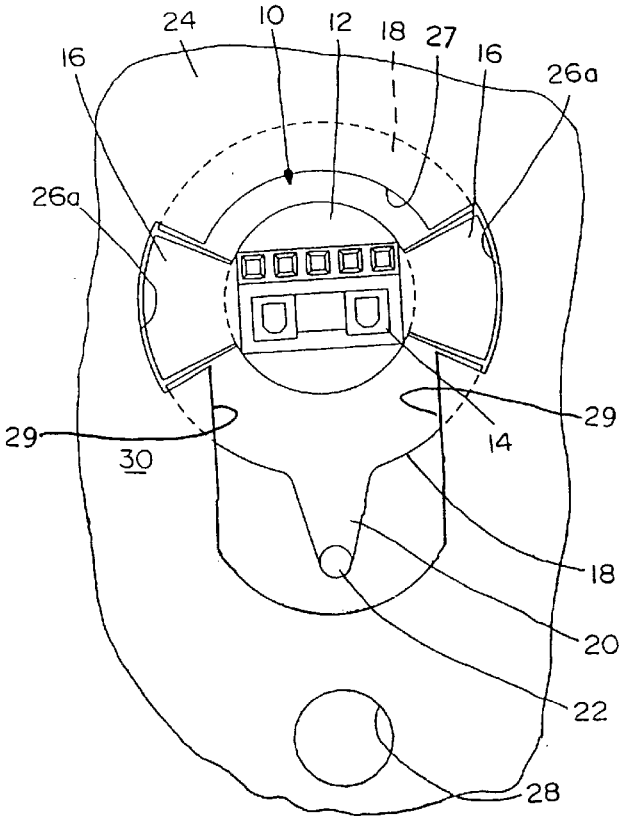
FIGS. 10–11 are views showing the insertion and mounted positions of the alternate embodiment of the invention.
Figure 11:
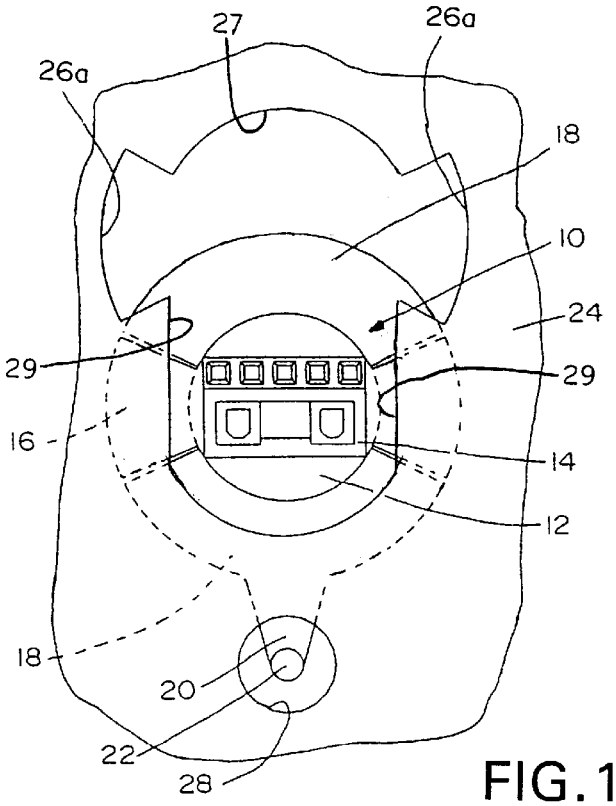

The connector 10 is mounted to the panel by first inserting housing 12 through first opening 27 (as shown in FIG. 10) to the insertion position. In that position locating flanges 16 move through locating portions 26*a* of the first opening until stop flanges 18 abut the insertion surface of the panel. As stated above, the locating flanges 16 clear the opposite surface 30 at the panel because of axial spacing "D" (shown in FIG. 1) between locating flanges and stop flanges. The connector can then be slid along elongated edges 29 in the direction of arrow "F" to a mounted position (FIG. 11) whereat locking projection 22, after first being bent to abut the insertion surface, registers with and snaps into second opening 28 in the panel. Since the second opening is substantially larger than the cross-sectional dimensions of locking projection 22, the housing can move in direction "A" (FIG. 5), "B" (FIG. 6), "C" (FIG. 7), or "E" (FIG. 8), while the locating flanges 16 and stop flanges 18 adjacent elongated edges 29 prevent axial movement of the housing out of the panel first opening.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector panel mounting system, comprising:

a panel having a given thickness between two surfaces and including a first opening formed with at least one radially extending locating portion and an adjacent U-shaped elongated portion, and a second opening spaced from the first opening;

a connector having a dielectric housing insertable from one surface of the panel along an insertion axis to an insertion position into the first opening in the panel, the housing having at least one radially extending locating flange for passing through the locating portion of the first opening as the housing is inserted thereinto and at least one radially extending stop flange spaced axially and angularly from the locating flange for abutting the one surface of the panel when the locating flange clears the opposite surface of the panel, the housing being slidable in a direction normal to the insertion axis along the elongated portion of the first opening from its insertion position to a mounted position whereat the locating flange can abut the opposite surface of the panel to prevent axial removal of the housing back out of the first opening, and the cross-sectional configuration of the housing being smaller than the first opening and when in the mounted position to provide rotational and lateral floating of the connector relative to the panel; and a locking arm projecting radially of the housing and including a locking protrusion for engagement in the second opening in the panel when the housing is in its mounted position and for preventing sliding of the connector from the mounted position back to the insertion position, the second opening being larger than the locking protrusion to allow for said rotational and lateral floating of the connector relative to the panel.

2. In an electrical connector panel mounting system as set forth in claim 1 wherein said second opening in the panel is circular to facilitate omni-directional rotational and lateral floating action of the connector.

3. In an electrical connector panel mounting system as set forth in claim 2 wherein said locking protrusion is generally cylindrical.

4. In an electrical connector panel mounting system as set forth in claim 1 wherein said housing is molded of plastic material and said locking arm is molded integrally therewith.

5. In an electrical connector panel mounting system as set forth in claim 1 wherein said locking arm is flexible such that said locking protrusion comprises a detent adapted for snapping into the second opening in the panel automatically when the housing is slid to its mounted position to lock the housing thereat.

* * * * *